US007588460B2

(12) United States Patent
Malloy et al.

(10) Patent No.: US 7,588,460 B2
(45) Date of Patent: Sep. 15, 2009

(54) COAXIAL CABLE CONNECTOR WITH GRIPPING FERRULE

(75) Inventors: Allen L. Malloy, Elmira Heights, NY (US); Gary Knaus, Horseheads, NY (US); Charles Thomas, Athens, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/075,005

(22) Filed: Mar. 7, 2008

(65) Prior Publication Data

US 2008/0261445 A1 Oct. 23, 2008

Related U.S. Application Data

(60) Provisional application No. 60/923,817, filed on Apr. 17, 2007.

(51) Int. Cl.
*H01R 9/05* (2006.01)

(52) U.S. Cl. ..... 439/578; 439/584

(58) Field of Classification Search ..... 439/578, 439/583, 582, 320–322, 585, 584; 179/89
See application file for complete search history.

(56) References Cited

U.S. PATENT DOCUMENTS

| | | | |
|---|---|---|---|
| 1,667,485 | A | 4/1928 | MacDonald |
| 2,258,737 | A | 10/1941 | Browne |
| 2,544,654 | A | 3/1951 | Brown |
| 2,549,647 | A | 4/1951 | Turenne |
| 3,184,706 | A | 5/1965 | Atkins |
| 3,275,913 | A | 9/1966 | Blanchard et al. |
| 3,292,136 | A | 12/1966 | Somerset |
| 3,350,677 | A | 10/1967 | Daum |
| 3,355,698 | A | 11/1967 | Keller |
| 3,373,243 | A | 3/1968 | Janowiak et al. |
| 3,406,373 | A | 10/1968 | Forney, Jr. |
| 3,448,430 | A | 6/1969 | Kelly |
| 3,475,545 | A | 10/1969 | Stark et al. |
| 3,498,647 | A | 3/1970 | Schroder |

(Continued)

FOREIGN PATENT DOCUMENTS

| | | |
|---|---|---|
| DE | 47931 | 10/1888 |

(Continued)

OTHER PUBLICATIONS

Sell Sheet from Stirling; www.StirlingUSA.com; Reader Service No. 109; regarding SPL-6-RTQ 3-In-One RTQ Connectors.

(Continued)

*Primary Examiner*—T C Patel
*Assistant Examiner*—Harshad C Patel
(74) *Attorney, Agent, or Firm*—Hoffmann & Baron, LLP

(57) ABSTRACT

A coaxial cable connector includes a connector body having a rearward cable receiving end, a locking sleeve movably coupled within the rearward cable receiving end of the connector body for locking the cable in the connector and a gripping ferrule disposed between the connector body and the locking sleeve. The gripping ferrule includes axially opposite gripping ends which move in a radially inward direction upon compression between the locking sleeve and the connector body to grip the outer surface of the cable.

20 Claims, 7 Drawing Sheets

U.S. PATENT DOCUMENTS

| | | | | | |
|---|---|---|---|---|---|
| 3,517,373 | A | | 6/1970 | Jamon | |
| 3,533,051 | A | | 10/1970 | Ziegler, Jr. | |
| 3,537,065 | A | | 10/1970 | Winston | |
| 3,544,705 | A | | 12/1970 | Winston | |
| 3,564,487 | A | | 2/1971 | Upstone et al. | |
| 3,629,792 | A | | 12/1971 | Dorrell | |
| 3,633,150 | A | | 1/1972 | Swartz | |
| 3,668,612 | A | | 6/1972 | Nepovim | |
| 3,671,922 | A | | 6/1972 | Zerlin et al. | |
| 3,694,792 | A | | 9/1972 | Wallo | |
| 3,710,005 | A | | 1/1973 | French | |
| 3,778,535 | A | | 12/1973 | Forney, Jr. | |
| 3,781,762 | A | | 12/1973 | Quackenbush | |
| 3,836,700 | A | | 9/1974 | Niemeyer | |
| 3,845,453 | A | | 10/1974 | Hemmer | |
| 3,846,738 | A | * | 11/1974 | Nepovim | 439/584 |
| 3,854,003 | A | | 12/1974 | Duret | |
| 3,879,102 | A | | 4/1975 | Horak | |
| 3,907,399 | A | | 9/1975 | Spinner | |
| 3,910,673 | A | | 10/1975 | Stokes | |
| 3,915,539 | A | | 10/1975 | Collins | |
| 3,936,132 | A | | 2/1976 | Hutter | |
| 3,963,320 | A | | 6/1976 | Spinner | |
| 3,976,352 | A | | 8/1976 | Spinner | |
| 3,980,805 | A | | 9/1976 | Lipari | |
| 3,985,418 | A | | 10/1976 | Spinner | |
| 4,046,451 | A | | 9/1977 | Juds et al. | |
| 4,053,200 | A | | 10/1977 | Pugner | |
| 4,059,330 | A | | 11/1977 | Shirey | |
| 4,093,335 | A | | 6/1978 | Schwartz et al. | |
| 4,126,372 | A | | 11/1978 | Hashimoto et al. | |
| 4,131,332 | A | | 12/1978 | Hogendobler et al. | |
| 4,150,250 | A | | 4/1979 | Lundeberg | |
| 4,156,554 | A | | 5/1979 | Aujla | |
| 4,165,554 | A | | 8/1979 | Faget | |
| 4,168,921 | A | | 9/1979 | Blanchard | |
| 4,225,162 | A | | 9/1980 | Dola | |
| 4,227,765 | A | | 10/1980 | Neumann et al. | |
| 4,250,348 | A | | 2/1981 | Kitagawa | |
| 4,280,749 | A | | 7/1981 | Hemmer | |
| 4,339,166 | A | | 7/1982 | Dayton | |
| 4,346,958 | A | | 8/1982 | Blanchard | |
| 4,354,721 | A | | 10/1982 | Luzzi | |
| 4,373,767 | A | | 2/1983 | Cairns | |
| 4,400,050 | A | | 8/1983 | Hayward et al. | |
| 4,408,821 | A | | 10/1983 | Forney, Jr. | |
| 4,408,822 | A | | 10/1983 | Nikitas | |
| 4,421,377 | A | | 12/1983 | Spinner | |
| 4,444,453 | A | | 4/1984 | Kirby et al. | |
| 4,456,323 | A | | 6/1984 | Pitcher et al. | |
| 4,484,792 | A | | 11/1984 | Tengler et al. | |
| 4,515,427 | A | | 5/1985 | Smit | |
| 4,533,191 | A | | 8/1985 | Blackwood | |
| 4,540,231 | A | | 9/1985 | Forney, Jr. | |
| 4,545,637 | A | | 10/1985 | Bosshard et al. | |
| 4,575,274 | A | | 3/1986 | Hayward et al. | |
| 4,583,811 | A | | 4/1986 | McMills | |
| 4,593,964 | A | | 6/1986 | Forney, Jr. et al. | |
| 4,596,434 | A | | 6/1986 | Saba et al. | |
| 4,596,435 | A | | 6/1986 | Bickford | |
| 4,598,961 | A | | 7/1986 | Cohen | |
| 4,600,263 | A | | 7/1986 | DeChamp et al. | |
| 4,614,390 | A | | 9/1986 | Baker | |
| 4,632,487 | A | | 12/1986 | Wargula | |
| 4,640,572 | A | | 2/1987 | Conlon | |
| 4,645,281 | A | | 2/1987 | Burger | |
| 4,650,228 | A | | 3/1987 | McMills et al. | |
| 4,655,159 | A | | 4/1987 | McMills | |
| 4,660,921 | A | | 4/1987 | Hauver | |
| 4,668,043 | A | | 5/1987 | Saba et al. | |
| 4,674,818 | A | | 6/1987 | McMills et al. | |
| 4,676,577 | A | | 6/1987 | Szegda | |
| 4,682,832 | A | | 7/1987 | Punako et al. | |
| 4,688,876 | A | | 8/1987 | Morelli | |
| 4,688,878 | A | | 8/1987 | Cohen et al. | |
| 4,691,976 | A | | 9/1987 | Cowen | |
| 4,703,987 | A | | 11/1987 | Gallusser et al. | |
| 4,717,355 | A | | 1/1988 | Mattis | |
| 4,738,009 | A | | 4/1988 | Down et al. | |
| 4,739,126 | A | * | 4/1988 | Gutter et al. | 174/78 |
| 4,746,305 | A | | 5/1988 | Nomura | |
| 4,747,786 | A | | 5/1988 | Hayashi et al. | |
| 4,755,152 | A | | 7/1988 | Elliot et al. | |
| 4,761,146 | A | | 8/1988 | Sohoel | |
| 4,772,222 | A | | 9/1988 | Laudig et al. | |
| 4,789,355 | A | | 12/1988 | Lee | |
| 4,806,116 | A | | 2/1989 | Ackerman | |
| 4,813,886 | A | | 3/1989 | Roos et al. | |
| 4,834,675 | A | | 5/1989 | Samchisen | |
| 4,854,893 | A | | 8/1989 | Morris | |
| 4,857,014 | A | | 8/1989 | Alf et al. | |
| 4,869,679 | A | | 9/1989 | Szegda | |
| 4,874,331 | A | | 10/1989 | Iverson | |
| 4,892,275 | A | | 1/1990 | Szegda | |
| 4,902,246 | A | | 2/1990 | Samchisen | |
| 4,906,207 | A | | 3/1990 | Banning et al. | |
| 4,923,412 | A | | 5/1990 | Morris | |
| 4,925,403 | A | | 5/1990 | Zorzy | |
| 4,927,385 | A | | 5/1990 | Cheng | |
| 4,929,188 | A | | 5/1990 | Lionetto et al. | |
| 4,952,174 | A | | 8/1990 | Sucht et al. | |
| 4,957,456 | A | | 9/1990 | Olson et al. | |
| 4,973,265 | A | | 11/1990 | Heeren | |
| 4,979,911 | A | | 12/1990 | Spencer | |
| 4,990,104 | A | | 2/1991 | Schieferly | |
| 4,990,105 | A | | 2/1991 | Karlovich | |
| 4,990,106 | A | | 2/1991 | Szegda | |
| 5,002,503 | A | | 3/1991 | Campbell et al. | |
| 5,007,861 | A | | 4/1991 | Stirling | |
| 5,021,010 | A | | 6/1991 | Wright | |
| 5,024,606 | A | | 6/1991 | Ming-Hwa | |
| 5,037,328 | A | | 8/1991 | Karlovich | |
| 5,062,804 | A | | 11/1991 | Jamet et al. | |
| 5,066,248 | A | | 11/1991 | Gaver, Jr. et al. | |
| 5,073,129 | A | | 12/1991 | Szegda | |
| 5,083,943 | A | | 1/1992 | Tarrant | |
| 5,120,260 | A | | 6/1992 | Jackson | |
| 5,127,853 | A | | 7/1992 | McMills et al. | |
| 5,131,862 | A | | 7/1992 | Gershfeld | |
| 5,141,451 | A | | 8/1992 | Down | |
| 5,161,993 | A | | 11/1992 | Leibfried, Jr. | |
| 5,195,906 | A | | 3/1993 | Szegda | |
| 5,205,761 | A | | 4/1993 | Nilsson | |
| 5,207,602 | A | | 5/1993 | McMills et al. | |
| 5,217,391 | A | | 6/1993 | Fisher, Jr. | |
| 5,217,393 | A | | 6/1993 | Del Negro et al. | |
| 5,269,701 | A | | 12/1993 | Leibfried, Jr. | |
| 5,283,853 | A | | 2/1994 | Szegda | |
| 5,284,449 | A | | 2/1994 | Vaccaro | |
| 5,295,864 | A | | 3/1994 | Birch et al. | |
| 5,316,494 | A | | 5/1994 | Flanagan et al. | |
| 5,338,225 | A | | 8/1994 | Jacobsen et al. | |
| 5,342,218 | A | | 8/1994 | McMills et al. | |
| 5,354,217 | A | | 10/1994 | Gabel et al. | |
| 5,362,251 | A | * | 11/1994 | Bielak | 439/394 |
| 5,371,819 | A | | 12/1994 | Szegda | |
| 5,371,821 | A | | 12/1994 | Szegda | |
| 5,371,827 | A | | 12/1994 | Szegda | |
| 5,393,244 | A | | 2/1995 | Szegda | |
| 5,431,583 | A | | 7/1995 | Szegda | |
| 5,435,745 | A | * | 7/1995 | Booth | 439/584 |
| 5,444,810 | A | | 8/1995 | Szegda | |
| 5,455,548 | A | | 10/1995 | Grandchamp et al. | |
| 5,456,611 | A | * | 10/1995 | Henry et al. | 439/180 |

| | | | | |
|---|---|---|---|---|
| 5,456,614 | A | 10/1995 | Szegda | |
| 5,466,173 | A | 11/1995 | Down | |
| 5,470,257 | A | 11/1995 | Szegda | |
| 5,494,454 | A | 2/1996 | Johnsen | |
| 5,501,616 | A | 3/1996 | Holliday | |
| 5,525,076 | A | 6/1996 | Down | |
| 5,542,861 | A | 8/1996 | Anhalt et al. | |
| 5,548,088 | A | 8/1996 | Gray et al. | |
| 5,571,028 | A | 11/1996 | Szegda | |
| 5,586,910 | A | 12/1996 | Del Negro et al. | |
| 5,598,132 | A | 1/1997 | Stabile | |
| 5,607,325 | A | 3/1997 | Toma | |
| 5,620,339 | A | 4/1997 | Gray et al. | |
| 5,632,651 | A | 5/1997 | Szegda | |
| 5,651,699 | A | 7/1997 | Holliday | |
| 5,667,405 | A | 9/1997 | Holliday | |
| 5,766,037 | A * | 6/1998 | Nelson | 439/583 |
| 5,863,220 | A | 1/1999 | Holliday | |
| 5,879,191 | A | 3/1999 | Burris | |
| 5,967,852 | A | 10/1999 | Follingstad et al. | |
| 5,975,951 | A | 11/1999 | Burris et al. | |
| 5,997,350 | A | 12/1999 | Burris et al. | |
| 6,032,358 | A | 3/2000 | Wild | |
| 6,089,912 | A | 7/2000 | Tallis | |
| 6,089,913 | A | 7/2000 | Holliday | |
| 6,146,197 | A | 11/2000 | Holliday et al. | |
| 6,210,222 | B1 | 4/2001 | Langham et al. | |
| 6,217,383 | B1 | 4/2001 | Holland | |
| 6,241,553 | B1 | 6/2001 | Hsia | |
| 6,261,126 | B1 | 7/2001 | Stirling | |
| 6,331,123 | B1 * | 12/2001 | Rodrigues | 439/584 |
| D458,904 | S | 6/2002 | Montera | |
| D460,739 | S | 7/2002 | Fox | |
| D460,740 | S | 7/2002 | Montera | |
| D460,946 | S | 7/2002 | Montera | |
| D460,947 | S | 7/2002 | Montena | |
| D460,948 | S | 7/2002 | Montena | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| D462,327 | S | 9/2002 | Montena | |
| D468,696 | S | 1/2003 | Montena | |
| 6,517,379 | B2 * | 2/2003 | Leve | 439/578 |
| 6,530,807 | B2 | 3/2003 | Rodrigues et al. | |
| 6,558,194 | B2 | 5/2003 | Montena | |
| 6,805,584 | B1 | 10/2004 | Chen | |
| 6,817,896 | B2 | 11/2004 | Deventhal | |
| 6,848,940 | B2 | 2/2005 | Montena | |
| 7,108,547 | B2 * | 9/2006 | Kisling et al. | 439/578 |
| 7,281,947 | B2 * | 10/2007 | Pescatore | 439/578 |
| 7,288,002 | B2 * | 10/2007 | Rodrigues et al. | 439/578 |
| 7,300,309 | B2 * | 11/2007 | Montena | 439/578 |
| 7,371,113 | B2 * | 5/2008 | Burris et al. | 439/578 |
| 7,387,531 | B2 * | 6/2008 | Cook | 439/578 |
| 2002/0119699 | A1 * | 8/2002 | Leve | 439/578 |
| 2004/0102089 | A1 | 5/2004 | Chee | |
| 2004/0229504 | A1 | 11/2004 | Liu | |
| 2005/0208827 | A1 | 9/2005 | Burris et al. | |

FOREIGN PATENT DOCUMENTS

| | | | |
|---|---|---|---|
| DE | 102289 | | 7/1897 |
| DE | 1117687 | | 11/1961 |
| DE | 1 515 398 | | 11/1962 |
| DE | 1 191 880 | | 4/1965 |
| DE | 2 221 936 | | 5/1972 |
| DE | 2 225 764 | | 5/1972 |
| DE | 2 261 973 | | 12/1972 |
| DE | 32 11 008 | A1 | 10/1983 |
| EP | 0 072 104 | B1 | 2/1983 |
| EP | 0 116 157 | A1 | 8/1984 |
| EP | 0 167 738 | A2 | 1/1986 |
| EP | 0 265 276 | B1 | 4/1988 |
| FR | 2 232 846 | | 6/1973 |
| FR | 2 234 680 | | 6/1974 |
| FR | 2 462 798 | | 2/1981 |
| GB | 589697 | | 3/1945 |
| GB | 1087228 | | 10/1967 |
| GB | 1 270 846 | | 4/1972 |
| GB | 2019 665 | A | 10/1979 |
| GB | 2 079 549 | A | 1/1982 |
| GB | 2079 549 | A | 1/1982 |
| WO | 93/24973 | | 12/1993 |
| WO | 96/08854 | | 3/1996 |
| WO | WO 01/86756 | | 11/2001 |

OTHER PUBLICATIONS

Sell Sheet from PCT International; Reader Service No. 133; regarding DRS Compression Connectors—description/features and benefits.

* cited by examiner

COAXIAL CABLE CONNECTOR WITH GRIPPING FERRULE

CROSS-REFERENCE TO RELATED APPLICATIONS

This application claims the benefit of U.S. Provisional Application No. 60/923,817, filed on Apr. 17, 2007, which is incorporated by reference herein in its entirety for all purposes.

BACKGROUND OF THE INVENTION

The present invention relates generally to connectors for terminating coaxial cable. More particularly, the present invention relates to a coaxial cable connector having structural features to enhance gripping of a coaxial cable and to provide sealing of the interior of the connector from the environment, while minimizing the steps required to prepare the end of a coaxial cable.

It has long been known to use connectors to terminate coaxial cable so as to connect a cable to various electronic devices such as televisions, radios and the like. Prior art coaxial connectors generally include a connector body having an annular collar for accommodating a coaxial cable, an annular nut rotatably coupled to the collar for providing mechanical attachment of the connector to an external device and an annular post interposed between the collar and the nut. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator. Upon assembly to a coaxial cable, the annular post is inserted between the foil covered insulator and the conductive shield of the cable.

Needless to say, the process of preparing an end of a coaxial cable for installation into a connector requires a modicum of skill and is somewhat time consuming. A further problem with current coaxial connectors is that in order to properly attach the connector to the coaxial shielded cable, a good deal of manual force must be applied to push the coaxial shielded cable over the barbs of the post. During conventional installation, the cable can buckle when the post with the barb is pushed between the foil and the braid and create an unsatisfactory electrical and mechanical connection. Thus, a mistake made in the preparation process may result in a faulty connector installation.

Another problem with current coaxial connectors is that they are often difficult to use with smaller diameter coaxial cables. In particular, current coaxial connectors often do not adequately grip smaller diameter coaxial shielded cables. Moreover, sealing the interior of the connector from outside elements also becomes more challenging with smaller diameter cables.

It is, therefore, desirable to provide a coaxial connector which minimizes the steps required to prepare an end of a coaxial cable. It would be further desirable to provide a coaxial cable connector that eliminates the need to use excessive force to push the post into the coaxial shielded cable and prevents buckling of the coaxial shielded cable. It would be still further desirable to provide a coaxial cable connector with structural features to enhance gripping and sealing, particularly with smaller diameter cables.

OBJECTS AND SUMMARY OF THE INVENTION

It is an object of the present invention to provide a coaxial cable connector for terminating a coaxial cable.

It is a further object of the present invention to provide a coaxial cable connector which reduces the steps required to prepare an end of a coaxial cable.

It is still a further object of the present invention to provide a coaxial cable connector having structure to enhance gripping and sealing of a coaxial cable, especially a small diameter coaxial cable.

In the efficient attainment of these and other objects, the present invention provides a coaxial cable connector. The connector of the present invention generally includes a connector body having a rearward cable receiving end, a locking sleeve movably coupled within the rearward cable receiving end of the connector body for locking the cable in the connector and a gripping ferrule disposed between the connector body and the locking sleeve. The gripping ferrule includes axially opposite gripping ends which move in a radially inward direction upon compression between the locking sleeve and the connector body to grip the outer surface of the cable.

In a preferred embodiment, the gripping ferrule preferably includes at least one flexible finger disposed at each opposite end of the ferrule, which deflects radially inward upon insertion of the locking sleeve into the connector body to grip a cable inserted into the connector and to prevent rearward removal of the cable from the connector body. The flexible fingers of the gripping ferrule preferably include a tapered forward end defining a sharp edge to enhance gripping of the cable. The connector body preferably includes an internal ramp portion for deflecting a forward flexible finger of the gripping ferrule radially inward and the locking sleeve preferably includes an internal ramp portion for deflecting a rearward flexible finger of the gripping ferrule radially inward upon insertion of the locking sleeve into the connector body. The gripping ferrule further preferably includes an internally threaded or corrugated inner surface adapted to threadably or otherwise engage an outer surface of a coaxial cable.

The connector further preferably includes an annular post disposed within the connector body and a nut rotatably coupled to the post. The annular post has a rearward cable insertion end disposed within the connector body, which preferably defines a sharp edge adapted to penetrate an end of the cable as the gripping ferrule is threaded on the outer surface of the cable.

The present invention further involves a method for terminating a coaxial cable in a connector. The method according to the present invention generally includes the steps of inserting an end of a cable into an axially movable locking sleeve disposed within a rearward cable receiving end of a connector body which has a gripping ferrule supported therein and moving the locking sleeve forward to compress opposite ends of the gripping ferrule around the cable at two locations. As a result of the present invention, the time required to prepare the end of a coaxial cable prior to installation on the connector is drastically reduced.

A preferred form of the coaxial connector, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
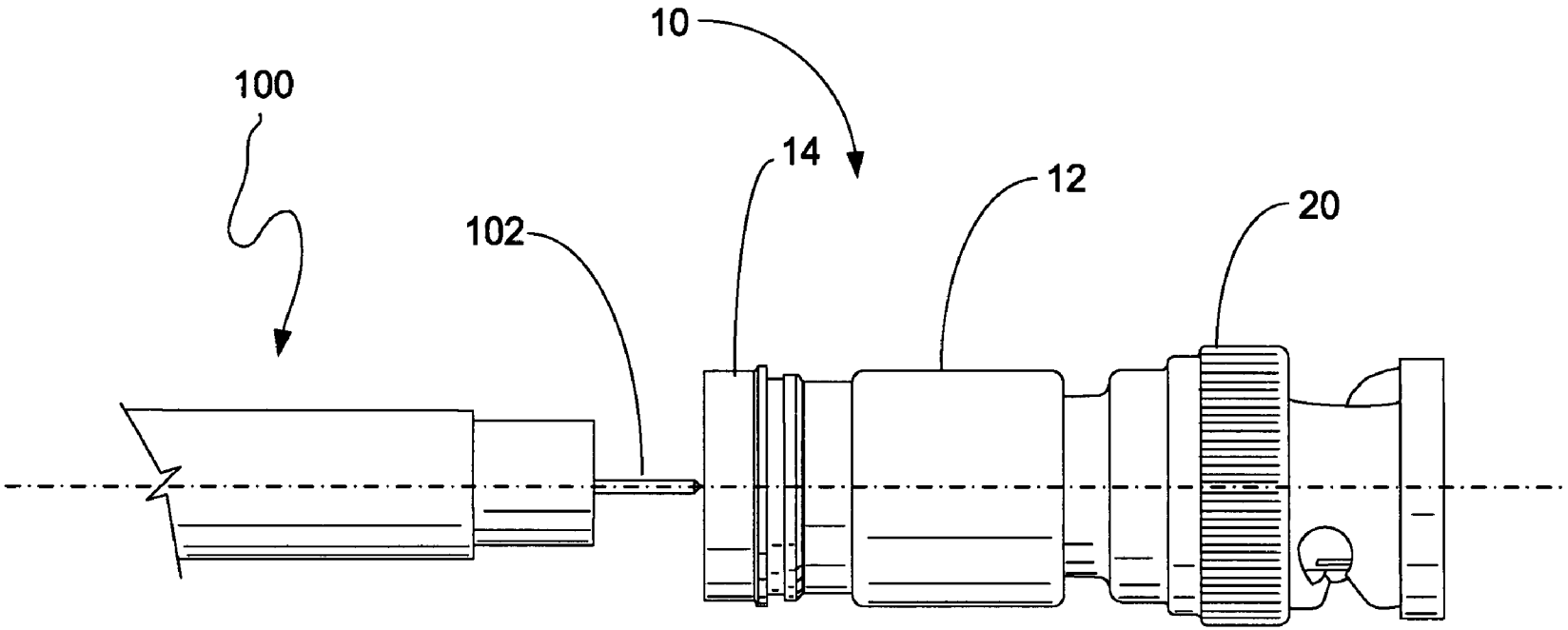
FIG. 1 is a perspective view of a coaxial cable being inserted into the coaxial cable connector of the present invention.
Figure 2:
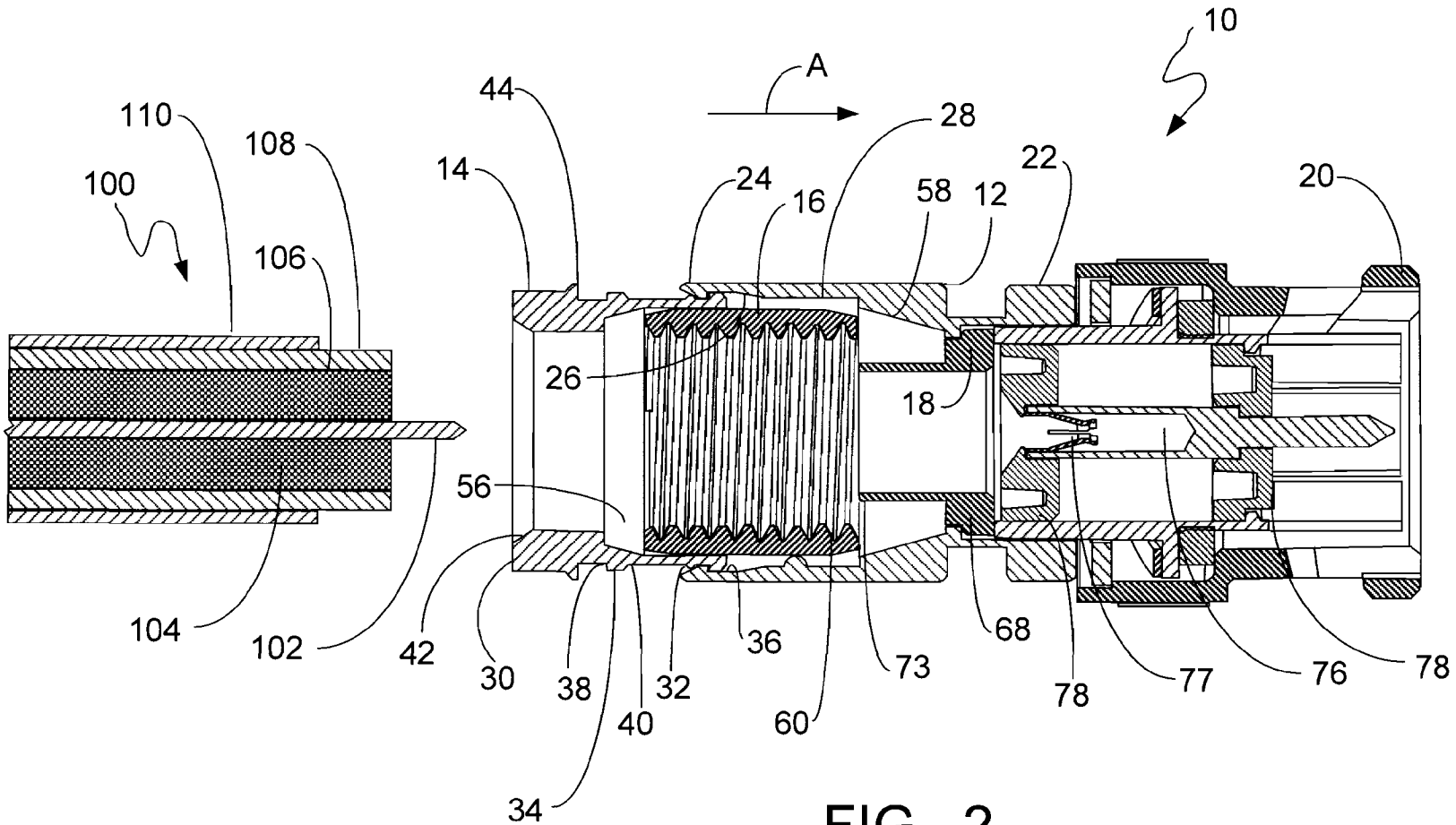
FIG. 2 is a cross-sectional view of the cable and connector shown in FIG. 1.
Figure 3:
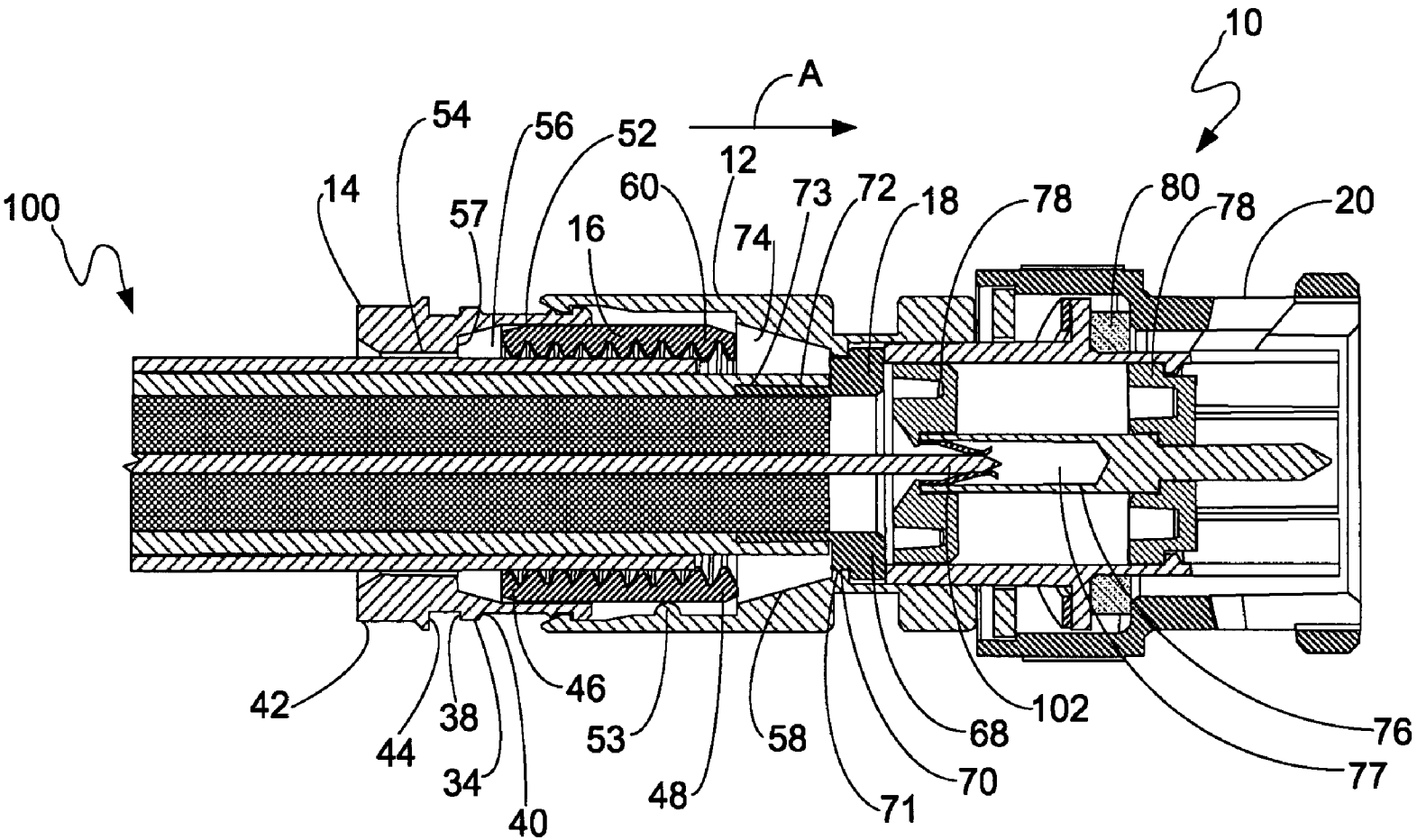
FIG. 3 is a cross-sectional view of the cable inserted into the connector of the present invention with the locking sleeve in an open position.

Referring now to the drawings, the coaxial cable connector 10 of the present invention generally includes a connector body 12, a locking sleeve 14 and a gripping ferrule 16. As will be discussed in further detail below, the connector of the present invention further preferably includes an annular post 18 and a rotatable nut 20. It is however conceivable that the connector body 12 and the post 18 can be integrated into one component and/or another fastening device other than the rotatable nut 20 can be utilized.

The connector body 12, also called a collar, is an elongate generally cylindrical member, which is preferably made from plastic to minimize cost. Alternatively, the body 12 may be made from metal or the like. The body 12 has a forward end 22 coupled to the post 18 and the nut 20 and an opposite cable receiving end 24 for insertably receiving the locking sleeve 14, as well as a prepared end of a coaxial cable 100 in the forward direction as shown by arrow A. Also disposed within the cable receiving end 24 of the connector body 12 is the gripping ferrule 16. The cable receiving end 24 of the connector body 12 defines an inner sleeve engagement surface 26 for coupling with the locking sleeve 14 and an inner ferrule engagement surface 28 disposed forward of the sleeve engagement surface 26 for frictionally engaging the gripping ferrule 16, as will be described in further detail below.

Figure 4:
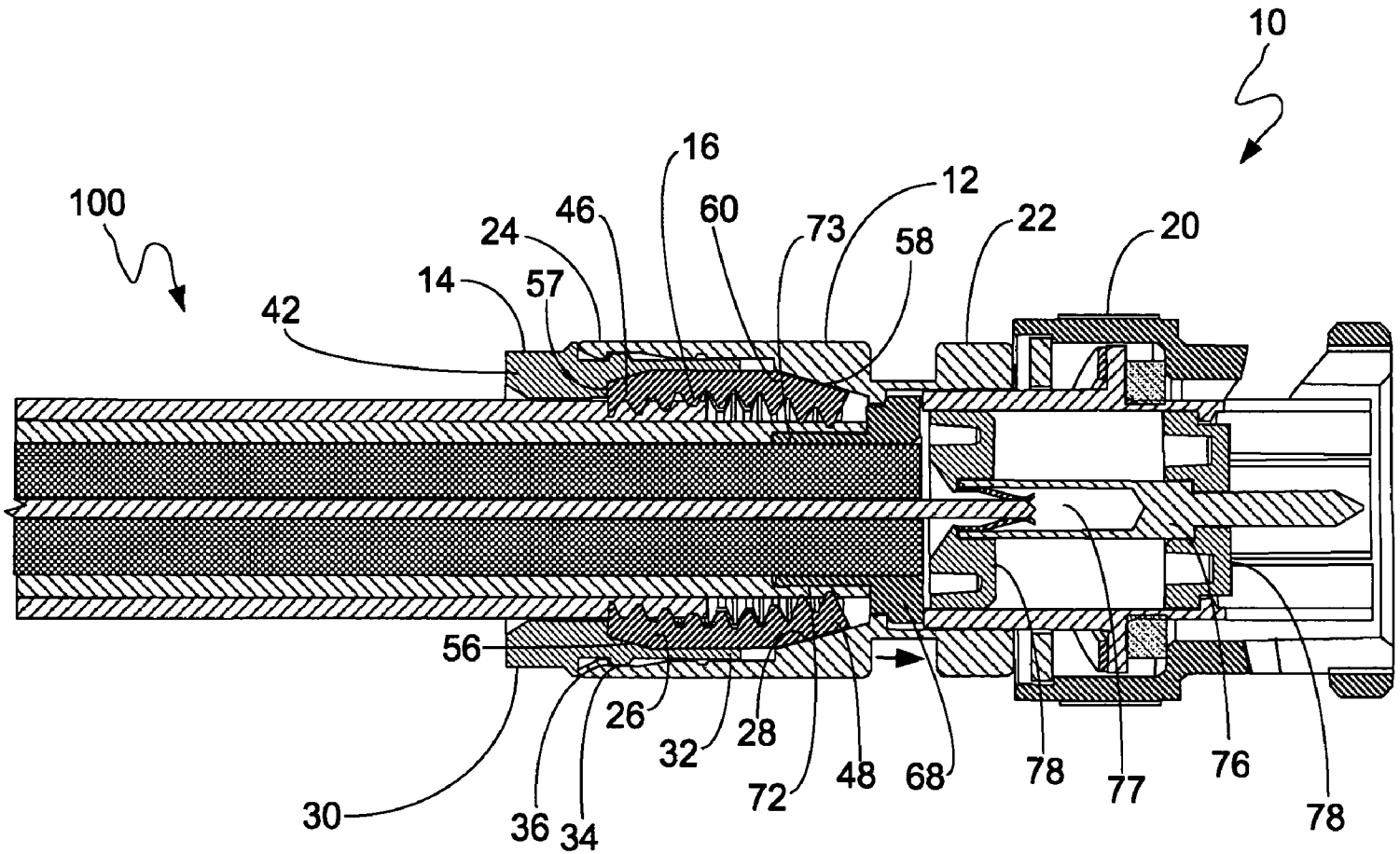
FIG. 4 is a cross-sectional view of the cable inserted into the connector of the present invention with the locking sleeve in a closed position.
Figure 5:
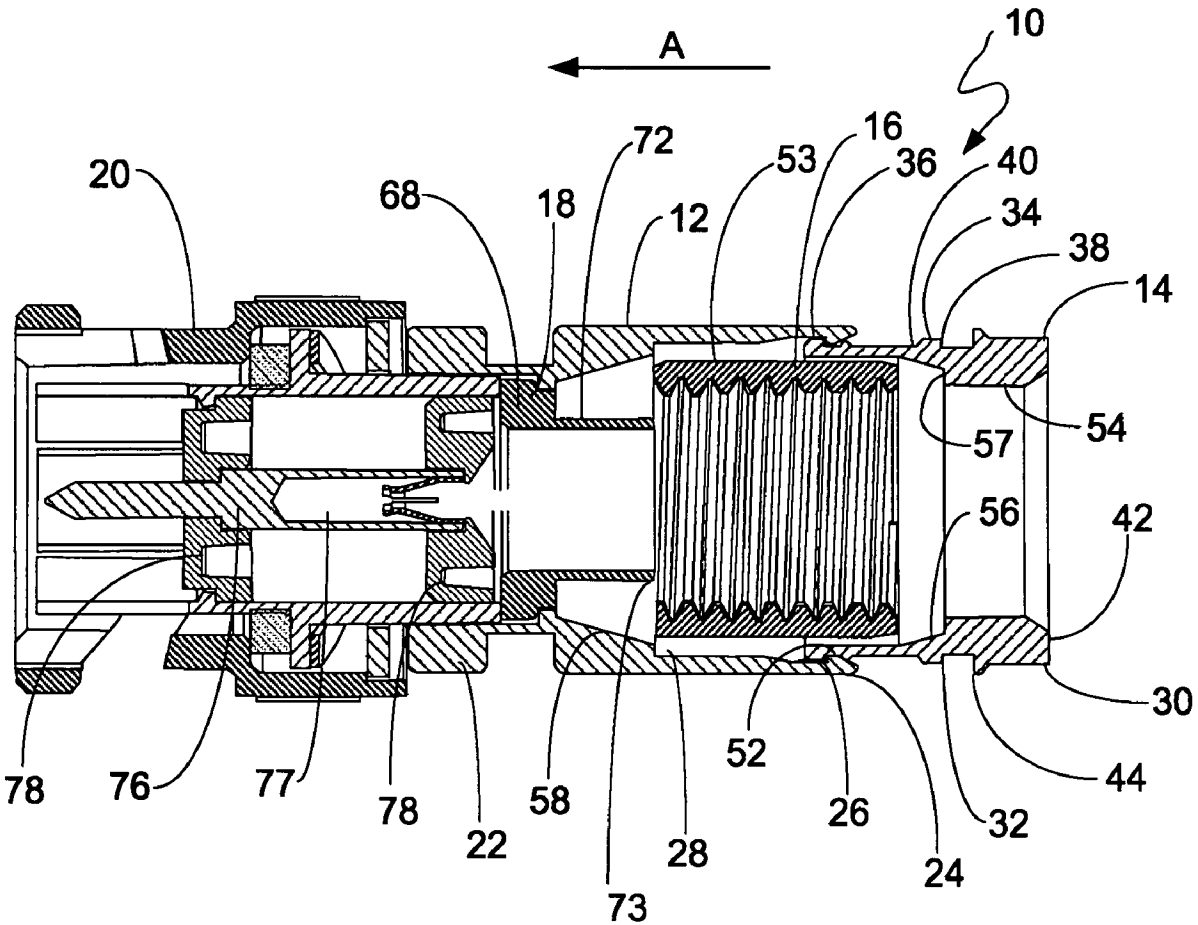
FIG. 5 is a cross-sectional view of the connector of the present invention with the cable not shown for clarity.
Figure 6:
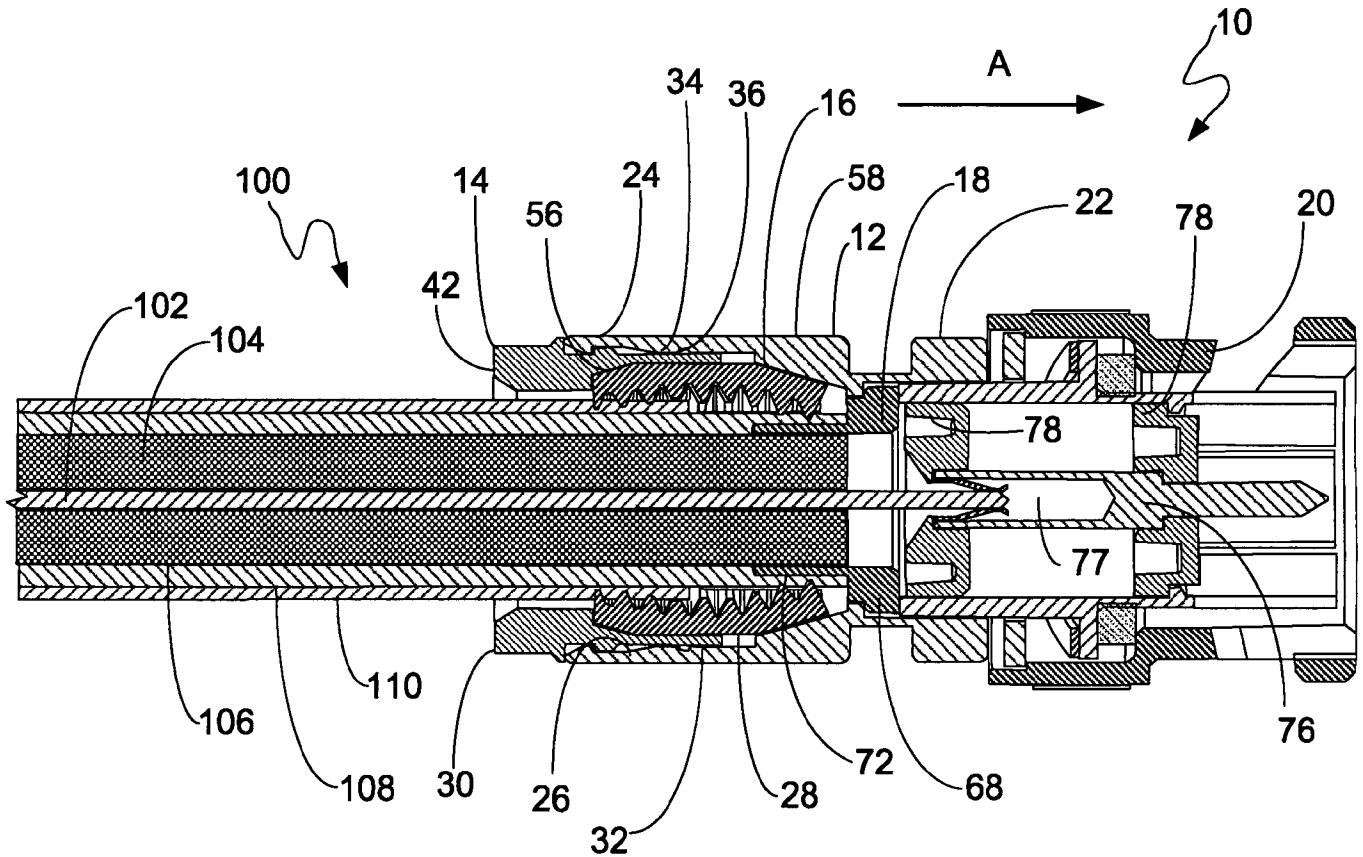
FIG. 6 is another cross-sectional view of the cable inserted into the connector of the present invention with the locking sleeve in a closed position.

The locking sleeve 14 is a generally tubular member having a rearward cable receiving end 30 and an opposite forward connector insertion end 32, which is movably coupled to the inner surface 26 of the connector body 12. As will be described in further detail hereinbelow, the forward outer cylindrical surface of the sleeve 14 includes a plurality of ridges or projections 34, which cooperate with a plurality of recesses or grooves 36 formed in the inner sleeve engagement surface 26 of the connector body to allow for the movable connection of the sleeve 14 to the connector body 12 such that the sleeve is axially moveable along arrow A of FIGS. 2-6, toward the forward end 22 of the connector body from a first position, as shown in FIGS. 1-3 and 5, which loosely retains the cable 100 within the connector 10, to a more forward second position, as shown in FIGS. 4 and 6, which secures the cable within the connector.

Specifically, formed on the outer cylindrical surface of the sleeve 14, between the rearward cable receiving end 30 and the forward insertion end 32 is at least one radially outwardly extending ridge or projection 34, which rests in a correspondingly sized groove 36 formed in the sleeve engagement surface 26 of the connector body 12. Preferably, there are two ridges 34 to provide locking of the sleeve 14 in both its first and second positions. Each ridge 34 is further preferably defined by a rearwardly facing perpendicular wall 38 and a forwardly facing chamfered wall 40. This structure facilitates forward insertion of the sleeve 14 into the body 12 in the direction of arrow A and resists rearward removal of the sleeve from the groove 36 of the body.

Moreover, the ridges or projections 34 of the present invention may take other forms. For example, while each ridge 34 is shown in the drawings to be continuous about the circumference of the locking sleeve 14, it is conceivable to provide gaps or spaces in one or more ridges to increase the ridge's flexibility. Also, the ridges 34 can be provided on the inner sleeve engagement surface 26 of the connector body, while the grooves are formed on the outer cylindrical surface of the sleeve 14.

The locking sleeve 14 further preferably includes a flanged head portion 42 disposed at the rearward cable receiving end 30 thereof. The head portion 42 has an outer diameter larger than the inner diameter of the body 12 and includes a forward facing perpendicular wall 44, which serves as an abutment surface against which the rearward end of the body 12 stops to prevent further insertion of the sleeve 14 into the body 12.

Figure 8:
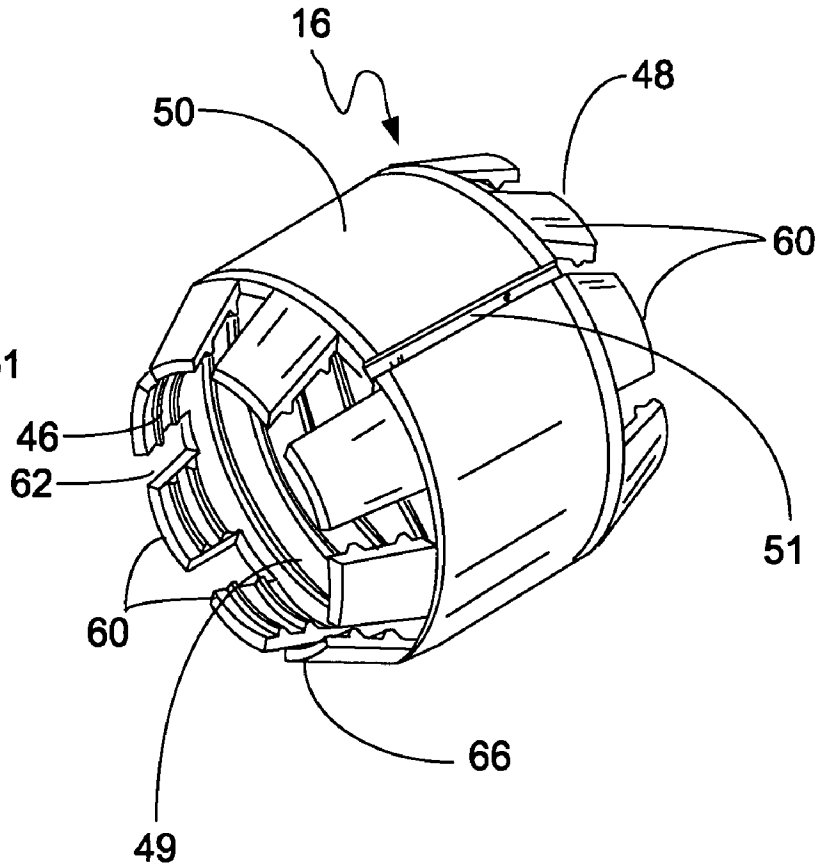
FIG. 8 is a perspective view of the gripping ferrule shown in FIG. 7 with the fingers shown deflected radially inward.
Figure 7:
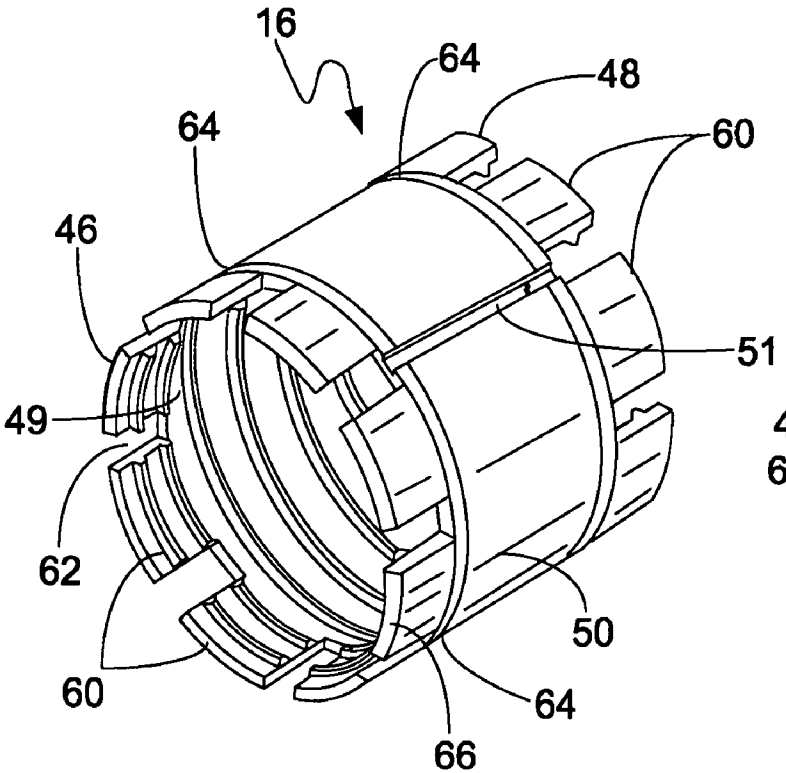
FIG. 7 is a perspective view of the preferred embodiment of the gripping ferrule of the present invention in isolation.

Referring additionally to FIGS. 7 and 8, the gripping ferrule 16 is a generally tubular member having a rearward cable gripping end 46 and an opposite forward cable gripping end 48. The gripping ferrule 16 is preferably made from a strong, durable plastic material to reduce costs, but may also be formed of a resilient metal. The tubular gripping ferrule 16 is preferably provided with a threaded inner surface 49 adapted to threadably engage the cable 100. The internal thread of the surface 49 has a diameter slightly smaller than the outside diameter of the cable for which the connector 10 is adapted to secure. Alternatively, the inner surface of the ferrule 16 can be corrugated or provided with other ridges or protrusions to enhance gripping of the cable 100. The gripping ferrule 16 further includes an outer surface 50, which frictionally engages the inner ferrule engagement surface 28 of the connector body 12 to retain the ferrule within the rearward end 24 of the connector body 12.

The locking sleeve 14 has a first inner diameter 52 at its forward end 32 that is sized to receive the rearward cable gripping end 46 of the gripping ferrule 16. Disposed rearward of the first inner diameter 52 is a smaller second inner diameter 54, which is sized to receive the outer diameter of the cable 100. Thus, as assembled, the forward connector insertion end 32 of the locking sleeve 14 is sandwiched between the outer surface 50 of the rearward cable gripping end 46 of the gripping ferrule 16 and the inner sleeve engagement surface 26 of the rearward cable receiving end 24 of the connector body 12. As a result, the locking sleeve 14 is axially movable between the gripping ferrule 14 and the connector body 12.

The locking sleeve 14 further includes an internal ramp portion 56 formed on its inner surface, which slopes radially outward in the forward direction. The internal ramp portion 56 defines a transition region on the inner surface of the locking sleeve 14 between the first diameter 52 and the smaller second diameter 54. The internal ramp portion 56 terminates at the smaller second diameter 54 at a forward facing wall 57. As will be discussed further below, the internal ramp portion 56 of the locking sleeve 14 serves to radially compress the rearward cable gripping end 46 of the gripping ferrule 16 upon forward insertion of the locking sleeve into the rearward end of the connector body 12. During this forward insertion, the wall 57 of the locking sleeve 14 retains the gripping ferrule 16 within the connector body 12.

Similarly, the inner ferrule engagement surface 28 of the connector body 12 is formed with an internal ramp portion 58, which slopes radially inward in the forward direction. The internal ramp portion 58 of the connector body 12 serves to radially compress the forward cable gripping end 48 of the gripping ferrule 16 upon forward insertion of the locking sleeve 14 into the rearward end 24 of the connector body 12.

Specifically, the gripping ferrule 16 is designed to expand radially inward at its opposite rearward and forward cable gripping ends 46 and 48, when compressed by the locking sleeve 14 in the axial direction along arrow A. This radially inward expansion of the rearward and forward cable gripping ends 46 and 48 will cause the gripping ferrule 16 to engage the outer surface of the cable 100 at two axially spaced locations to further secure the cable to the connector. Secondly, the ferrule 16 provides a redundant sealing point to prevent the ingress of water or other contaminants into the connector assembly 10.

To enhance such radially inward expansion, the forward and rearward cable gripping ends 46 and 48 of the gripping ferrule 16 are preferably formed with a plurality of circumferentially arranged flexible fingers 60 extending in opposite longitudinal directions. The fingers 60 may be formed simply by providing longitudinal slots or recesses 62 at the forward and rearward ends 46 and 48 of the ferrule 16. Moreover, a lateral groove 64 can also be provided between the fingers 60 and the body of the ferrule to increase the flexibility of the fingers. The lateral grooves 64 also preferably define forward and rearward facing banking surfaces, which abut against the internal ramp structure 56 and 58 respectively formed on the inner surface of the locking sleeve 14 and the connector body 12 to prevent further compression of the ferrule within the rearward end 24 of the connector body.

In this embodiment, the internal ramp structure 56 and 58 respectively formed on the inner surface of the locking sleeve 14 and the connector body 12 forces the forward and rearward flexible fingers 60 of the gripping ferrule 16 to deflect radially inward during insertion of the locking sleeve 14 into the body 12. These inwardly directed fingers 60 engage the cable 100 at two axially spaced locations to enhance the gripping of the cable within the connector 10. In this regard, each of the fingers 60 may further include a tapered end so as to form a relatively sharp edge 66. The sharp edge 66 tends to bite into the cable to provide even greater gripping force and prevent the cable from being pulled out of the connector 10.

As mentioned above, the connector 10 of the present invention further preferably includes an annular post 18 coupled to the forward end 22 of the connector body 12. The annular post 18 includes a flanged base portion 68 at its forward end for securing the post in the connector body 12. The flanged base portion 68 can include one or more radially outwardly extending protrusions 70, which are received in correspondingly sized recess or grooves 71 formed in the inner surface of the connector body 12 to "snap-fit" lock the post 18 in the connector body.

The annular post 18 further includes an annular tubular extension 72 extending rearwardly within the body 12 and terminating adjacent the forward end 48 of the gripping ferrule 16. The rearward end 73 of the tubular extension 72 can include a radially outwardly extending ramped flange portion or "barb" (not shown) to enhance compression of the outer jacket of the coaxial cable 100 against the forward end 48 of the gripping ferrule 16 to secure the cable within the connector. In any event, the rearward end 73 of the tubular extension 72 preferably terminates in a sharp edge, which facilitates separation of the metallic foil from the metallic shield of the cable during installation, as will be discussed in further detail below. The tubular extension 72 of the post 18, the gripping ferrule 16 and the body 12 define an annular chamber 74 for accommodating the jacket and shield of the inserted coaxial cable 100.

The present invention is particularly suited for coaxial connectors having an integral terminal pin, although use in other types of connectors is fully contemplated. In integral pin-type connectors, the post 16 further includes an internal pin 76 centrally disposed therein and having a central bore 77 formed in a rearward distal end thereof for receiving the central conductor 102 of a cable 100. In this embodiment, the post 16 further includes one or more annular insulators 78 to support the pin 76 in an axially central orientation within the post.

As mentioned above, the present invention may also be incorporated in a coaxial cable connector which does not utilize an integral pin. The coaxial cable connector in this embodiment would be identical to the connector shown in the drawings with the exception that the integral pin 76 and the annular insulators 78 would be removed from the post 18. Use would also be the same except for a slight variation in the preparation of the coaxial cable 100. In particular, a longer extent of the center conductor 102 would need to be provided in order for the cable 100 to be installed in a connector not having an integral pin.

The connector 10 of the present invention further preferably includes a nut 20 rotatably coupled to the forward end 22 of the connector body 12. The nut 20 may be in any form, such as a hex nut, knurled nut, wing nut, or any other known attaching means, and is rotatably coupled to the connector body 12 for providing mechanical attachment of the connector 10 to an external device. A resilient sealing O-ring 80 is preferably positioned in the nut 20 to provide a water resistant seal thereat.

The connector 10 of the present invention is constructed so as to be supplied in the assembled condition shown in the drawings, wherein the locking sleeve 14 and the gripping ferrule 16 are pre-installed inside the rearward cable receiving end 24 of the connector body 12. In such assembled condition, and as will be described in further detail hereinbelow, a coaxial cable 100 may be inserted through the rearward cable gripping end 46 of the gripping ferrule 116 to engage the post 18 of the connector 10. However, it is conceivable that the locking sleeve 14 and the gripping ferrule 16 can be first slipped over the end of a cable 100 and then be inserted into the rearward end 24 of the connector body 12 together with the cable.

Having described the components of the connector 10 in detail, the use of the connector in terminating a coaxial cable 100 may now be described. Coaxial cable 100 includes an inner conductor 102 formed of copper or similar conductive material. Extending around the inner conductor 102 is an insulator 104 formed of a dielectric material, such as a suitably insulative plastic. A metallic foil 106 is disposed over the insulator 104 and a metallic shield 108 is positioned in surrounding relationship around the foil covered insulator. Covering the metallic shield 108 is an outer insulative jacket 110.

The present invention reduces the steps required to prepare the end of the cable. Specifically, instead of having to strip back the jacket 110 to expose an extent of shield 108 and then folding the shield back over the jacket, the present invention merely requires the jacket 110 of the cable 100 to be cleanly cut leaving a portion of the foil covered insulator 104 exposed and then cutting the insulator 104 so that a length of the center conductor 102 extends outwardly therefrom ("¼ to ¼ prep"). The end of the cable 100 is then inserted into the connector body 12 so that the cable jacket 110 makes contact with the cable engagement surface 49 of the gripping ferrule 16. With a threaded cable engagement surface 49, the cable 100 and the connector body 12 can then be oppositely rotated or twisted with respect to each other so that the threads of the cable engagement surface 49 bite into the outer jacket 110 of the cable.

The gripping ferrule 16 and/or the inner ferrule engagement surface 28 of the connector body 12 can be provided with structure to prevent rotation of the ferrule with respect to the connector body during such threading motion. For example, the outer surface 50 of the gripping ferrule 16 can be formed with one or more longitudinal grooves 51, which engage one or more tabs 53 provided on the inner ferrule engagement surface 28 of the connector body 12 to prevent rotation of the ferrule with respect to the connector body.

As the connector body 12 is threaded onto the cable 100, the cable is brought further forward into the connector body whereby the sharp edge 73 of the post 18 is driven between the metallic foil 106 and the metallic shield 108 of the cable. Also during this threading motion, the center conductor 102 of the cable is received within the central bore 77 of the integral pin 76. As may be appreciated, the threading motion between the connector body 12 and the cable 100 provides a mechanical advantage in driving the end of the cable into engagement with the post 18. Moreover, the short tubular extension 72 of the post 18 and its position at the end of the ¼ to ¼ prep, before the jacket, decreases the insertion force for the cable. As a result, the force required for installing the cable 100 into the connector 10, along with the associated possibility of buckling the coaxial cable, is greatly reduced as compared with conventional coaxial cable connectors.

Once the cable 100 is fully inserted in the connector body 12, the locking sleeve 14 is moved axially forward in the direction of arrow A from the first position shown in FIGS. 1-3 and 5 to the second position shown in FIGS. 4 and 6. This may be accomplished with a suitable compression tool. As the sleeve 14 is moved axially forward, it provides compressive force on the gripping ferrule 16, which in turn causes the opposite rearward and forward ends 46 and 48 of the ferrule to expand radially inward. The rearward cable gripping end 46 of the ferrule 16 expands inward to grip the outer surface of the cable jacket 110, while the forward cable gripping end 48 of the ferrule expands inward to compress the foil covered insulator 104 against the outer surface of the tubular extension 72 of the post 18.

As described above, such radially inward expansion is facilitated by the internal ramped structure 56 and 58 provided in the locking sleeve 14 and the connector body 12. In the preferred embodiment, the internal ramp 56 of the locking sleeve 14 works against a plurality of flexible fingers 60 formed at the rearward end 46 of the gripping ferrule 16, while the internal ramp 58 of the connector body 12 works against a plurality of flexible fingers 60 provided at the forward end 48 of the gripping ferrule, wherein the fingers 60 at each end deflect inwardly to exert a radial compressive force on the cable 100 at two axially spaced locations.

Thus, as a result of the present invention, the cable 100 is prevented from being easily pulled out of the connector 10 by two separate and spaced points of pressure. The present invention further allows for faster and easier preparation of the cable, regardless of cable diameter, percentage of braid and jacket material type (e.g., PE, PVC, Plenum).

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector comprising:

a connector body having a rearward cable receiving end;

a locking sleeve movably coupled to said rearward cable receiving end of said connector body; and a tubular gripping ferrule disposed within said connector body, said gripping ferrule having a central body portion and axially opposite gripping ends extending from said central body portion, said gripping ends moving radially inward with respect to said central body portion upon axial movement of said locking sleeve to grip a cable inserted within said connector body at two axially spaced locations.

2. A coaxial cable connector as defined in claim 1, wherein at least one gripping end of said gripping ferrule comprises at least one flexible finger extending in an axial direction, said flexible finger deflecting radially inward upon axial movement of said locking sleeve.

3. A coaxial cable connector as defined in claim 2, wherein said flexible finger includes a tapered forward end defining a sharp edge to facilitate gripping of the cable.

4. A coaxial cable connector as defined in claim 1, wherein said connector body includes an internal ramp portion for facilitating inward radial movement of a gripping end of said gripping ferrule.

5. A coaxial cable connector as defined in claim 1, wherein said locking sleeve includes an internal ramp portion for facilitating inward radial movement of a gripping end of said gripping ferrule.

6. A coaxial cable connector as defined in claim 1, wherein said gripping ferrule includes a threaded inner surface for threadably engaging a cable.

7. A coaxial cable connector as defined in claim 6, wherein said gripping ferrule includes structure for preventing rotation of said gripping ferrule with respect to at least one of said connector body and said locking sleeve.

8. A coaxial cable connector as defined in claim 1, wherein said gripping ferrule includes a corrugated inner surface for engaging a cable.

9. A coaxial cable connector as defined in claim 1, further comprising an annular post disposed within said connector body, said annular post including a tubular extension extending axially toward said gripping ferrule.

10. A coaxial cable connector as defined in claim 9, wherein a forward gripping end of said gripping ferrule moves radially inward to compress a portion of the cable against said tubular extension of said post upon movement of said locking sleeve.

11. A coaxial cable connector comprising:

a connector body having a rearward cable receiving end;

a locking sleeve movably coupled to said rearward cable receiving end of said connector body; and a tubular gripping ferrule disposed within said connector body, said gripping ferrule having axially opposite gripping ends, said gripping ends moving radially inward upon axial movement of said locking sleeve to grip a cable inserted within said connector body at two axially spaced locations, wherein said connector body includes an internal ramp portion for facilitating inward radial movement of a forward gripping end of said gripping ferrule, and wherein said locking sleeve includes an internal ramp portion for facilitating inward radial movement of a rearward gripping end of said gripping ferrule.

12. A method for terminating a coaxial cable in a connector comprising the steps of:

inserting an end of a cable into a rearward cable receiving end of a connector body; and axially moving a locking sleeve coupled to said connector body, wherein said movement of said locking sleeve causes opposite axial ends of a gripping ferrule disposed within said connector body to move radially inward with respect to a central body portion of said gripping ferrule to grip the cable at two axially spaced locations.

13. A method as defined in claim 12, wherein at least one gripping end of said gripping ferrule comprises at least one flexible finger extending in an axial direction, said flexible finger deflecting radially inward upon axial movement of said locking sleeve.

14. A method as defined in claim 13, wherein said flexible finger includes a tapered forward end defining a sharp edge to facilitate gripping of the cable.

15. A method as defined in claim 12, wherein said connector body includes an internal ramp portion for facilitating inward radial movement of a gripping end of said gripping ferrule during said step of axially moving said locking sleeve.

16. A method as defined in claim 12, wherein said locking sleeve includes an internal ramp portion for facilitating inward radial movement of a gripping end of said gripping ferrule during said step of axially moving said locking sleeve.

17. A method for terminating a coaxial cable in a connector comprising the steps of:

inserting an end of a cable into a rearward cable receiving end of a connector body; and axially moving a locking sleeve coupled to said connector body, wherein said movement of said locking sleeve causes opposite axial ends of a gripping ferrule disposed within said connector body to move radially inward to grip the cable at two axially spaced locations, wherein said connector body includes an internal ramp portion for facilitating inward radial movement of a forward gripping end of said gripping ferrule during said step of axially moving said locking sleeve, and wherein said locking sleeve includes an internal ramp portion for facilitating inward radial movement of a rearward gripping end of said gripping ferrule during said step of axially moving said locking sleeve.

18. A method as defined in claim 12, wherein said gripping ferrule includes a threaded inner surface for threadably engaging the cable, and wherein said cable insertion step comprises the step of threading said gripping ferrule on the end of the cable.

19. A method as defined in claim 12, wherein said gripping ferrule includes a corrugated inner surface for engaging a cable.

20. A method as defined in claim 12, wherein said connector body further includes an annular post having a tubular extension extending axially toward said gripping ferrule and a forward gripping end of said gripping ferrule moves radially inward to compress a portion of the cable against said tubular extension of said post upon movement of said locking sleeve.

* * * * *